US008068034B2

(12) United States Patent
Shah et al.

(10) Patent No.: US 8,068,034 B2
(45) Date of Patent: Nov. 29, 2011

(54) SAFETY SENSOR DEVICE

(75) Inventors: Reza Shah, Acton (CA); Peter M. Callahan, legal representative, Oakville (CA); Eajaz Zaheer, Brampton (CA); Yee Bing Hoo, Scarborough (CA); Timothy SoeMoe Thu, Mississauga (CA)

(73) Assignee: Pioneering Technology Corp., Mississauga (CA)

( * ) Notice: Subject to any disclaimer, the term of this patent is extended or adjusted under 35 U.S.C. 154(b) by 318 days.

(21) Appl. No.: 12/271,528

(22) Filed: Nov. 14, 2008

(65) Prior Publication Data

US 2009/0207029 A1 Aug. 20, 2009

Related U.S. Application Data

(60) Provisional application No. 60/987,957, filed on Nov. 14, 2007.

(51) Int. Cl.
*G08B 17/10* (2006.01)
*G08B 1/00* (2006.01)

(52) U.S. Cl. ..... 340/628; 340/632; 340/532

(58) Field of Classification Search ..... 340/628, 340/629, 630, 632, 691.1, 693.1, 693.2, 514, 340/531, 532; 62/231; 361/42; 219/506, 219/703; 307/116, 117
See application file for complete search history.

(56) References Cited

U.S. PATENT DOCUMENTS

| | | | | |
|---|---|---|---|---|
| 3,952,294 | A | 4/1976 | Emerson et al. | |
| 4,038,649 | A | 7/1977 | Dobrzanski | |
| 4,194,192 | A | 3/1980 | Albinger, Jr. | |
| 4,694,285 | A | 9/1987 | Scripps | |
| 4,763,115 | A | 8/1988 | Cota | |
| 4,827,244 | A * | 5/1989 | Bellavia et al. | 340/514 |
| 5,508,568 | A * | 4/1996 | Mammen | 307/117 |
| 5,524,448 | A * | 6/1996 | Schwanebeck et al. | 62/231 |
| 5,592,032 | A * | 1/1997 | Keizer et al. | 307/116 |
| 5,734,206 | A * | 3/1998 | Keizer et al. | 307/116 |
| 6,046,441 | A * | 4/2000 | Daffron | 219/481 |
| 7,043,543 | B2 * | 5/2006 | Ewing et al. | 709/223 |
| 7,154,402 | B2 | 12/2006 | Dayoub | |
| 7,199,721 | B2 | 4/2007 | Shirlee | |
| 2005/0280961 | A1 * | 12/2005 | Campolo | 361/42 |
| 2008/0018484 | A1 * | 1/2008 | Sager | 340/628 |

FOREIGN PATENT DOCUMENTS

CA 1337706 12/1995

* cited by examiner

*Primary Examiner* — Van T. Trieu
(74) *Attorney, Agent, or Firm* — Bereskin & Parr LLP/S.E.N.C.R.L., s.r.l.

(57) ABSTRACT

A safety sensor device for an appliance detects burning conditions and shuts off power to the appliance. The device includes a sensor unit positioned near an exhaust of the appliance, and a relay unit connected along a power supply path to the appliance. The relay and sensor units are linked. The sensor unit includes a sensor for monitoring exhaust air from the appliance. The relay unit includes a circuit that electrically connects the appliance with a power source while in an ON state and electrically disconnects the appliance from the power source while in an OFF state, the circuit being responsive to the sensor unit to transition from the ON state to the OFF state if the sensor detects burning conditions.

21 Claims, 10 Drawing Sheets

300A

SAFETY SENSOR DEVICE

RELATED APPLICATION

This application claims the benefit under 35 USC 119(e) of U.S. Patent Application No. 60/987,957, filed Nov. 14, 2007, the entirety of which is incorporated herein by this reference to it.

FIELD

This application relates generally to safety devices for appliances.

INTRODUCTION

The following paragraphs are not an admission that anything discussed in them is prior art or part of the knowledge of persons skilled in the art.

There are devices and methods known for the detection and indication of smoke. For example, household smoke detectors are quite common. These devices are typically small, battery-operated units that are generally affixed to the ceiling.

U.S. Pat. No. 7,154,402 discloses a power strip with an internal smoke detection device, which cuts off AC electrical power to attached electrical devices if smoke is detected.

Canadian Patent No. 1,337,706 discloses a safety device for shutting off the power supply to a food heating appliance, typically a stove or range, or detection of a condition, such as smoke, indicative of burning food.

SUMMARY

In one aspect of this specification, a safety sensor device can comprise: a sensor unit comprising a sensor configured to monitor exhaust air from an appliance; and a unit linked to the sensor unit, the unit comprising a circuit operable to electrically connect the appliance with a power source while in an ON state and electrically disconnect the appliance from the power source while in an OFF state, the circuit being responsive to the sensor unit to transition from the ON state to the OFF state if the sensor detect at least one of burning conditions or at least one predetermined substance in air in excess of a predetermined concentration.

In another aspect of this specification, an appliance and a safety sensor device are provided in combination. The appliance can comprise: an exhaust area and a power cord. The safety sensor device can comprise: a sensor unit positioned generally above the exhaust area of the appliance, the sensor unit comprising a sensor configured to monitor air emanating from the exhaust area of the appliance; and a relay unit linked to the sensor unit, the relay unit comprising a circuit operable to electrically connect the power cord of the appliance with a power outlet while in an ON state and electrically disconnect the power cord from the power outlet while in an OFF state, the circuit being responsive to the sensor unit to transition from the ON state to the OFF state if the sensor detects burning conditions.

In yet another aspect of this specification, a method of monitoring use of an appliance can comprise: positioning a sensor unit near an exhaust area of the appliance, the sensor unit configured to monitor exhaust air emanating from the appliance; connecting a relay unit to a power supply path of the appliance, the relay unit linked to the sensor unit, the relay unit operable to electrically connect the appliance to a power source while in an ON state and electrically disconnect the appliance from the power source while in an OFF state, the relay unit response to the sensor unit to transition from the ON state to the OFF state if burning conditions are detected.

These and other features of the applicant's teachings are set forth herein.

DRAWINGS

A detailed description of one or more embodiments is provided herein below by way of example only and with reference to the following drawings, in which.

DETAILED DESCRIPTION

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. One or more inventions may reside in a combination or sub-combination of the apparatus elements or method steps described below or in other parts of this document. It is possible that an apparatus or method described below is not an embodiment of any claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A safety sensor device for an appliance is disclosed for detecting burning conditions and shutting off power to the appliance. The device includes a sensor unit positionable near an exhaust of the appliance, and a relay unit connectable along a power supply path to the appliance. The relay and sensor units are linked. The sensor unit includes a sensor for monitoring exhaust air from the appliance. The relay unit includes a circuit that electrically connects the appliance with a power source while in an ON state and electrically disconnects the appliance from the power source while in an OFF state, the circuit being responsive to the sensor unit to transition from the ON state to the OFF state if the sensor detects at least one of burning conditions or at least one predetermined substance in air in excess of a predetermined concentration.

Figure 1A:
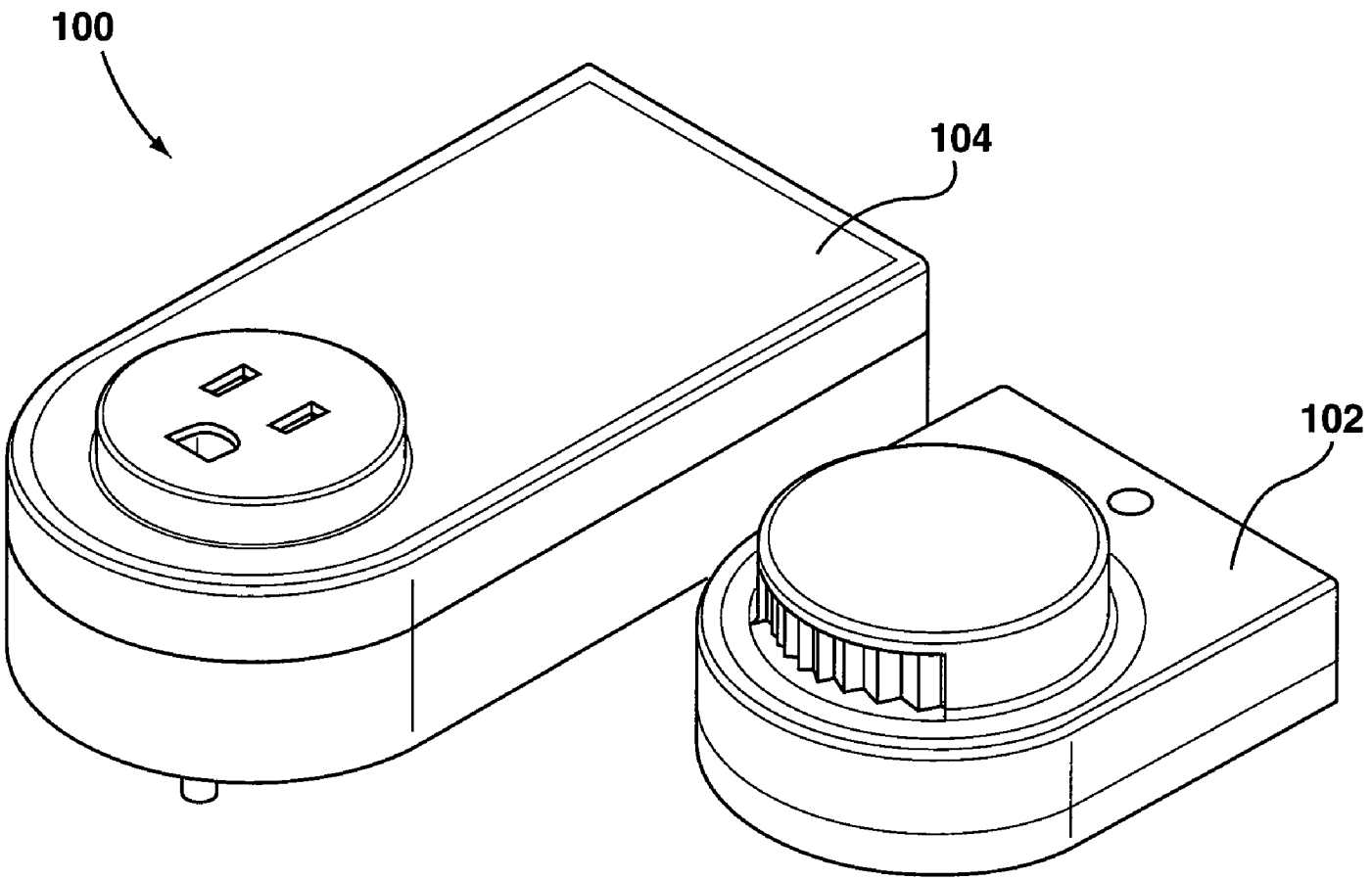
FIG. 1A shows a safety sensor device.
Figure 1B:
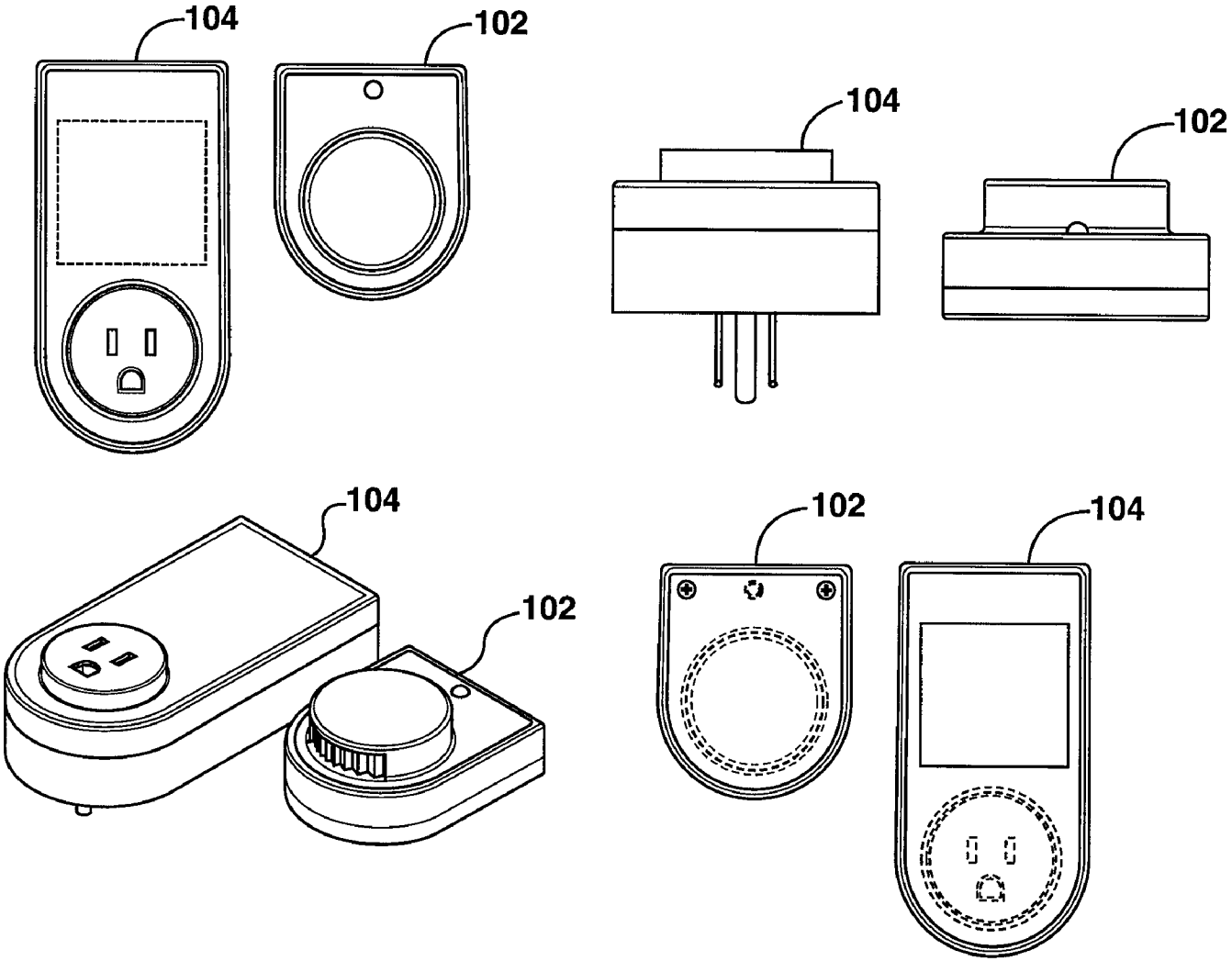
FIG. 1B shows further views of the safety sensor device.

Referring to FIGS. 1A and 1B, an example of a safety sensor device 100 can includes two separate modules or units: a sensor unit 102; and a relay or power control unit 104.

It is to be understood that while the term "relay unit" is used herein, this need not comprise a conventional electromagnetic relay but more generally refers to any device connectable between the power supply path and operable to interrupt the power supply.

Figure 2:
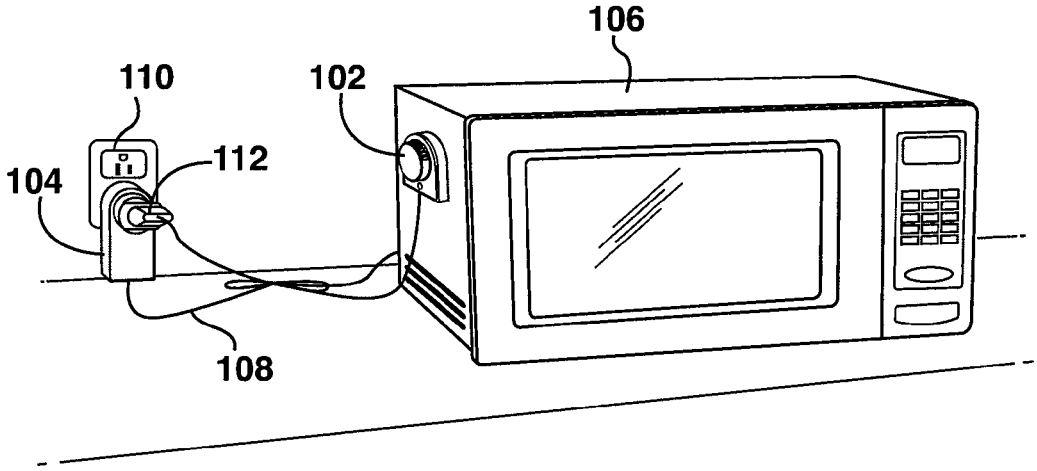
FIG. 2 shows the safety sensor device in use with an appliance.
Figure 2:
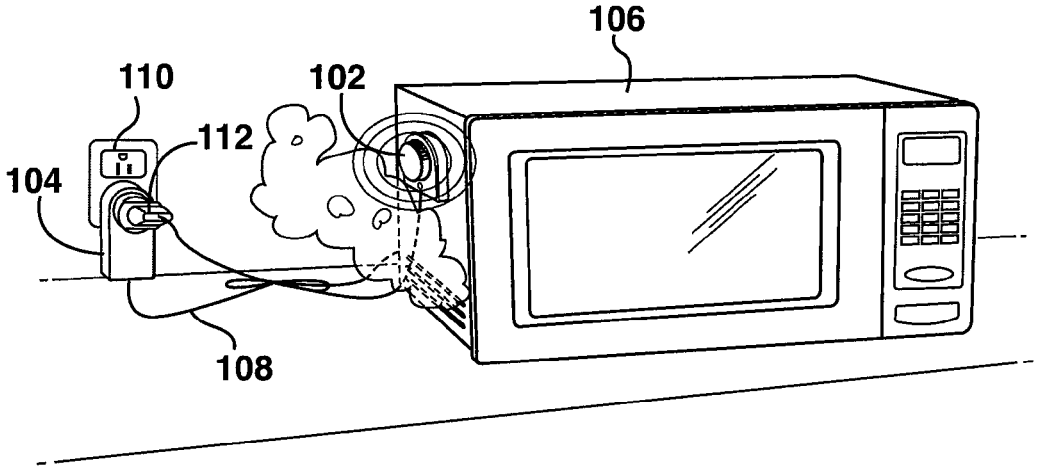

Referring to FIG. 2, the sensor unit 102 can be positioned near an exhaust area of an appliance 106. As illustrated, appliance 106 can be a food-heating appliance, for example but not limited to, a microwave. The sensor unit 102 can be positioned generally above the exhaust area in order to capture the exhaust air emanating from the appliance 106. The relay unit 104 can be linked or connected to the sensor unit 102 by a cable 108. Although a cable 108 is illustrated, other connection means are possible. For example, the sensor unit 102 and the relay unit 104 can be connected wirelessly, using Bluetooth™ or another wireless technology. If wireless technology is implemented to link the sensor unit 102 with the relay unit 104, then the sensor unit 102 may include a battery so that a power cord does not encumber it.

The relay unit 104 can be connected along a power supply path of the appliance 106. In this case, the relay unit 104 is provided between a typical wall electrical outlet 110 and a plug 112 of the appliance 106. The sensor unit 102 can be configured to monitor exhaust air emanating from the appliance 106. The relay unit 104 can be configured to electrically connect the plug 112 with the power outlet 110 while in an ON state and electrically disconnect the plug 112 from the outlet 110 while in an OFF state, with the relay unit 104 responsive to the sensor unit 102 to transition from the ON state to the OFF state if the sensor detects burning conditions. The OFF state may last for duration of a pre-determined interval, e.g., 60 seconds. The interruption of power flowing between the outlet 110 and the plug 112 stops operation of the appliance 106 operation to cease heating of the food and may prevent smoke from setting off the room or building smoke detectors, and may prevent fire.

It should be appreciated that the device 100 can be relatively easy to install and use: the sensor unit 102 can be positioned near or on the appliance 106. In some examples, the sensor unit 102 can be positioned magnetically, and at a point generally near and above the exhaust area of the appliance 106. The exhaust area of the appliance can be, for example but not limited to, exhaust side vents. The plug 112 of the appliance 106 then plugs into the relay unit 104, and the relay unit 104 can be plugged into the wall outlet 110. The relay unit 104 can be configured to interrupt the power supply path to the appliance 106 in response to the sensor unit 102 detecting smoke at a level indicative of burning conditions. Advantageously, the device 100 may require no change to cooking behavior.

Figure 3:
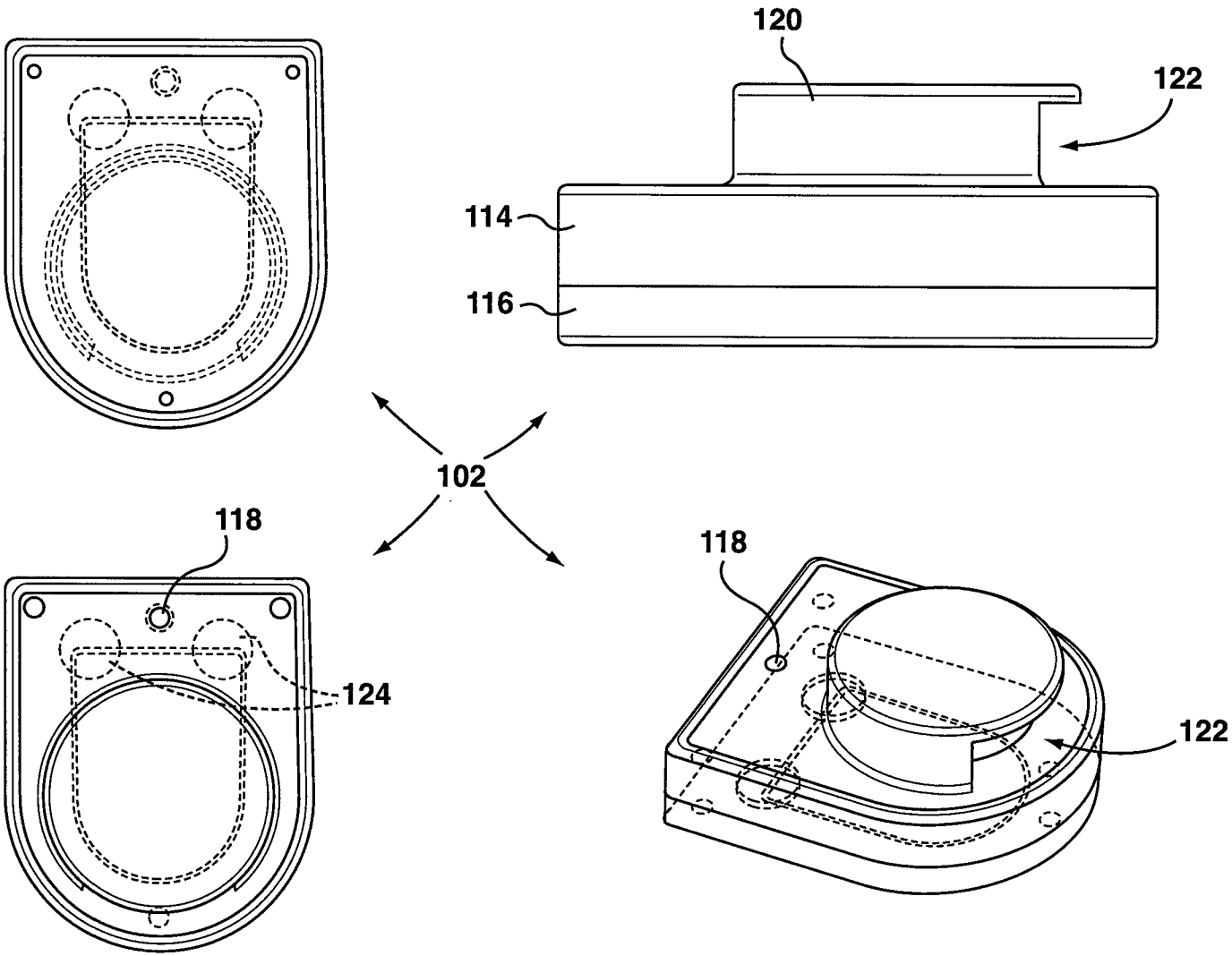
FIG. 3 shows views of a sensor unit.

Referring to FIG. 3, the sensor unit 102 includes complementary housing portions 114, 116, an LED 118, and a raised portion 120 on the housing portion 114 defining a smoke trap 122. The sensor unit 102 may include magnets 124 for allowing it to be easily positioned along a side vertical surface of the appliance. The sensor unit 102 can be positioned so that the smoke trap 114 can be provided directly above and relatively close to an exhaust area, e.g., one or more vents, so that the smoke trap 114 can trap exhaust air emanating from the exhaust area. The exhaust air can be fed by the smoke trap 114 into a smoke sensor provided internally in the sensor unit 102. In this example, the sensor unit 102 may also include a piezoelectric transducer as an alarm buzzer. The piezoelectric transducer and internal drivers can be configured to sound an audible alarm in response to sensing smoke.

During normal usage of the device, some amount of smoke can enter the sensor chamber, and residue may be left in the sensor chamber. To address this problem, in some examples, the smoke trap 122 can include a filter or mesh member (not shown) to prevent undesirable particulate matter from entering the sensor provided internally in the sensor unit 102. The mesh member can be detachable allowing cleaning or replacement. In some other examples, the sensor unit 102 can include a sensor head (not shown) housing a detector board, sensor chamber and mesh member. The sensor head can be removable to allow cleaning of the mesh, or replacement of the entire sensor head.

Figure 4:
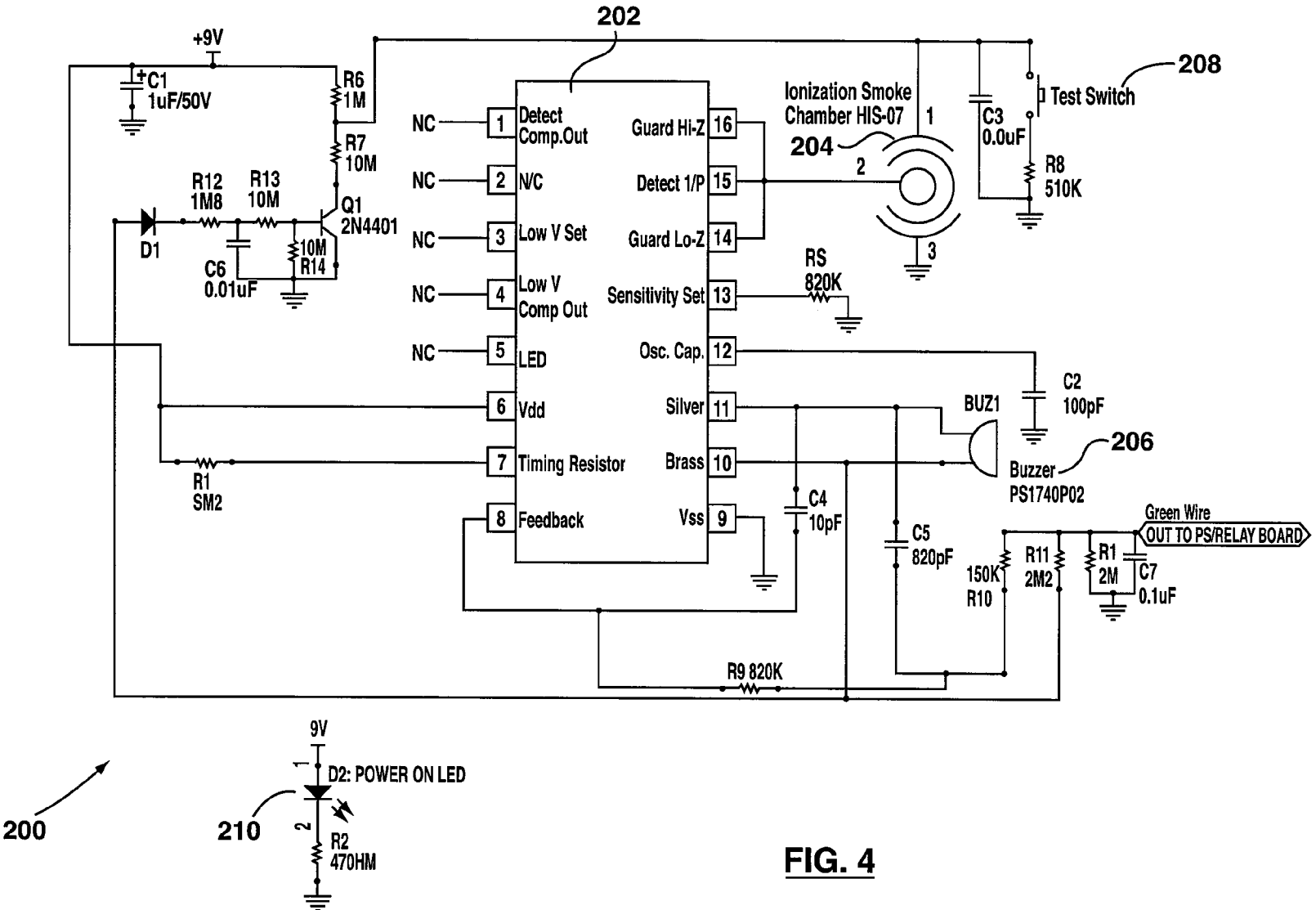
FIG. 4 shows an example circuit for the sensor unit.

Referring to FIG. 4, an example of an electrical circuit 200 for the sensor unit 102 is provided. In some examples, as illustrated, an ionization sensor means can be used including the electrical circuit 200 and can comprise a sensor circuit 202 connected to an ionization chamber 204. The chamber 204 and the circuit 202 are operable to detect smoke in the exhaust air indicative of burning conditions. The sensor circuit can be a Motorola™ MC14667-1 detector circuit, for example. The smoke sensitivity threshold can be set using the resistor R5. Selecting an appropriate value of resistor R5 can allow for the device 100 to cook foods in a normal manner, but shut off the electrical power once excess smoke is sensed. The inventors have found that a resistor R5 of 820 kΩ can be suitable for cooking popcorn in a commercially available microwave. In other words, a resistor R5 of 820 kΩ has been found to be a suitable sensitivity to allow popcorn to cook in the microwave, but capable of signaling the relay unit 104 to switch to the OFF state if the popcorn begins to burn. (In contrast, the resistor R5 for the circuit for use in a typical household smoke detector application would be 2-3 MΩ, for example.) An LED 210 can be included, e.g., a flashing LED indicates that the sensor unit 102 is monitoring the particular appliance.

Smoke particles entering the ionization chamber 204 generate signals typically of only a few pico-amperes. This signal is buffered by the sensor circuit 202. If smoke is detected by the sensor circuit and chamber 201, 204, the oscillator period becomes 40 ms and the piezoelectric transducer oscillator circuit is enabled. The buzzer 206 output is modulated. During the OFF time, the exhaust air is scanned and will stop further buzzer output if no smoke is detected. A test mode may also be provided, e.g., the ionization chamber 204 can be checked periodically by pressing a test switch 208, which may also activate the buzzer.

In some other examples, a photoelectric sensor (not shown) can be used in place of the ionization sensor means described herein. The photoelectric sensor can be operable to detect smoke in the exhaust air indicative of burning conditions. In yet other examples, a laser sensor can be implemented in place of the ionization sensor means described herein.

Figure 5:
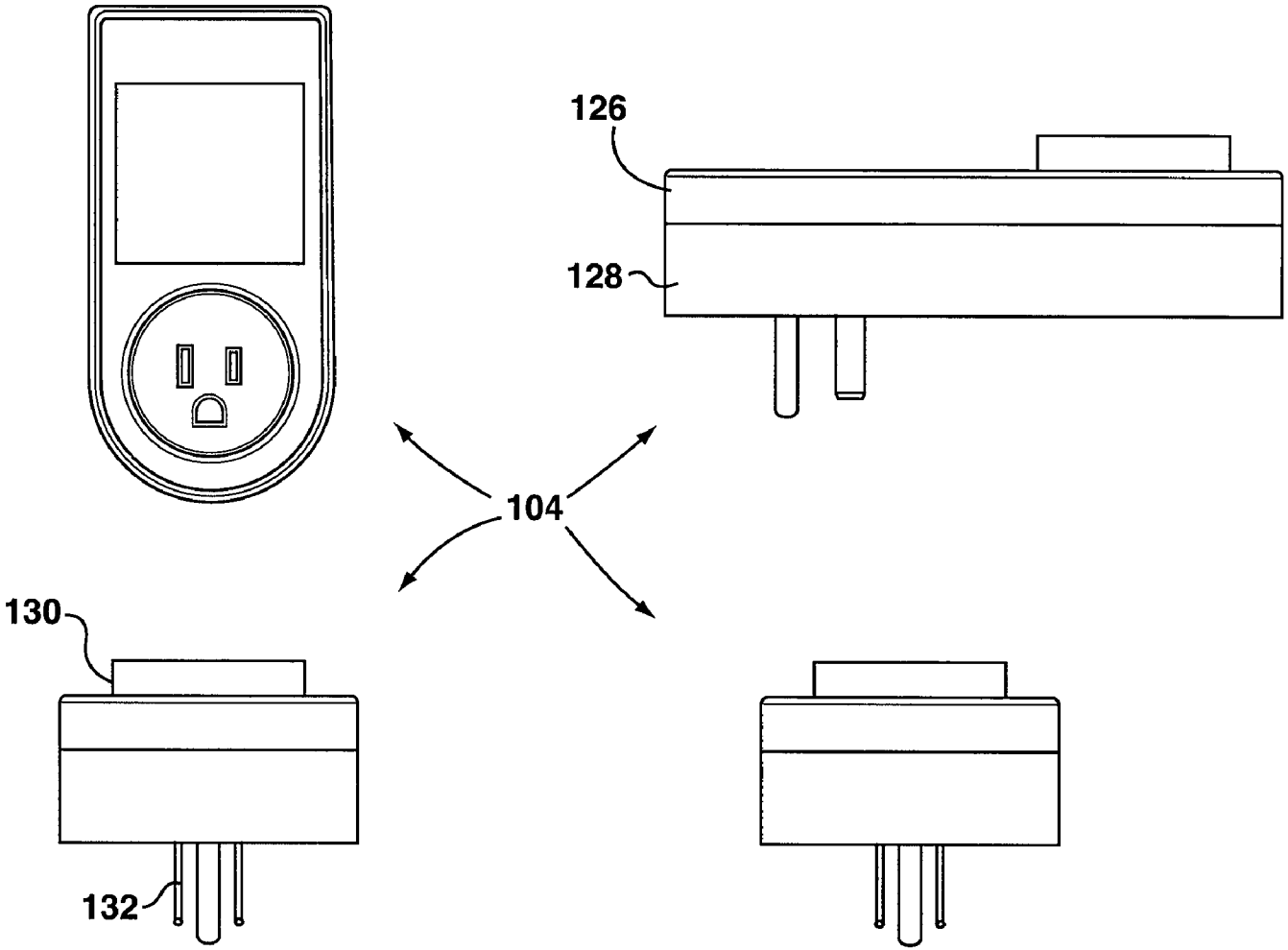
FIG. 5 shows views of a relay unit.

Referring to FIG. 5, the relay unit 104 can include complementary portions 126, 128, female electrical connection 130 and electrical prongs 132. The relay unit 104 is operable to electrically connect the appliance with a power source while in an ON state and electrically disconnect the appliance from the power source while in an OFF state, the relay unit 104 being responsive to the sensor unit 102 to transition from the ON state to the OFF state if burning conditions are detected. The relay unit 104 may include a timing circuit for timing an interval during which the OFF state is maintained, the relay unit 104 transitioning to the ON state after duration of the interval.

The relay unit 104 also supplies 9 VDC to the sensor unit 102 and simultaneously provides the normal relay that serves power to the appliance (in the ON state). The relay unit 104 is connected to 120 VAC mains, and therefore may need to be electrically isolated from the sensor unit 102 it is connected to. The sensor unit 102 includes the sensor circuit and chamber 202, 204, which may have a metal casing or cover that is connected to the ground. If there is no electrical isolation of the power ground and the circuit ground, there is the potential of an electrical shock to a user in case a power supply component fails. This electrical isolation can be achieved by one of the following two methods, for example: (i) a switched mode power supply (SMPS) in the relay unit 104; or (ii) a transformer power supply in the relay unit 104.

Figure 6A:
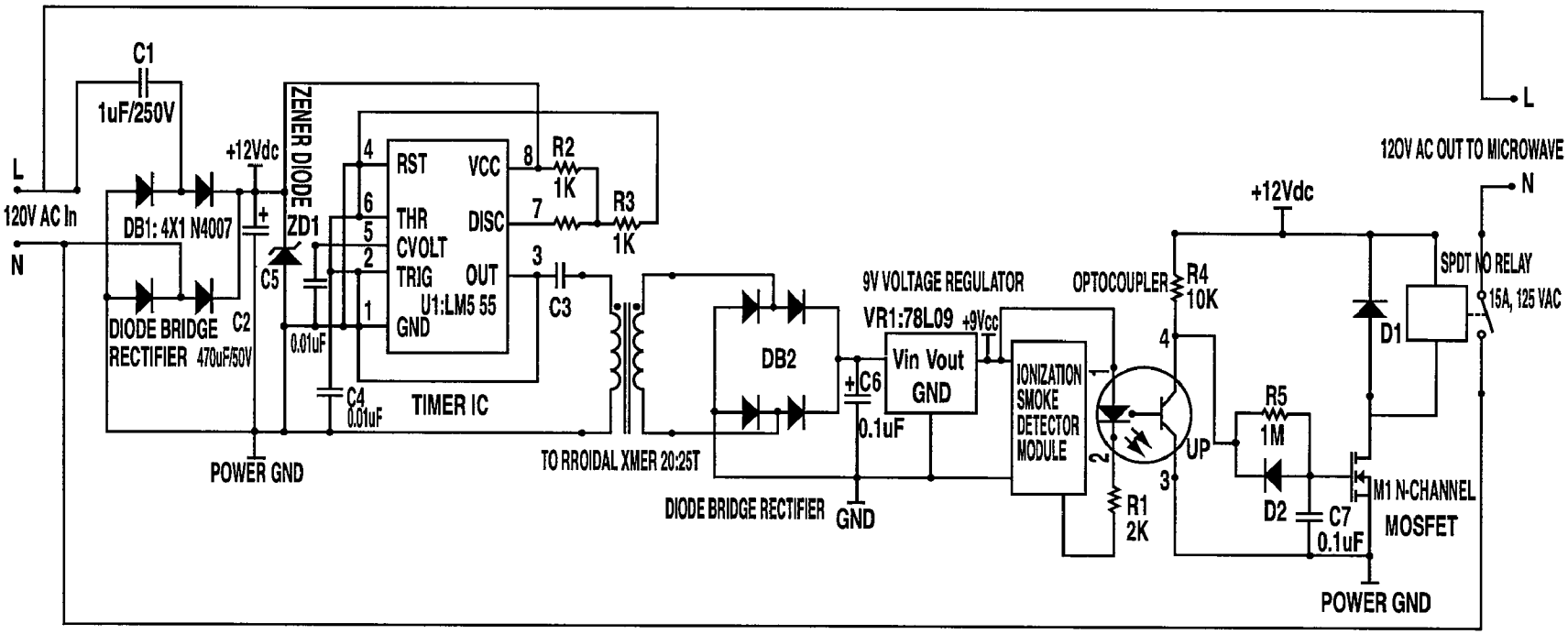
FIG. 6A shows an example circuit for the relay unit.

Referring to FIG. 6A, an example of an electrical circuit 300A for the relay unit 104 is provided, in this case a SMPS or "transformerless" power supply. The circuit comprises a torroidal coil and an opto-coupler. Power is supplied by the regular 120 VAC electric power supply. Electrical isolation is achieved by using an opto-coupler on the relay side and a torroidal transformer on the power supply side. This transformer-less power supply uses a charge/discharge capacitor C1 to filter AC 60 Hz line voltage, which is applied to the bridge rectifier diodes (DB1). This rectified voltage is then fed to timer integrated circuit (U1) that converts it into pulsed AC voltage. This voltage is then applied to the primary windings of a torroid type transformer which provides the electrical isolation of the ground. It is then fed again to a small signal diode bridge rectifier (DB2), which rectifies it into DC voltage. This DC voltage is regulated by the voltage regulator, which provides 9 VDC to the sensor unit 102. The sensor circuit is operable to send a signal (in response to detecting smoke) to trigger the opto-coupler to turn off. This trips the circuit. Power is automatically returned when the smoke clears. On the relay side, the electrical isolation is provided by the opto-coupler circuit.

Figure 6B:
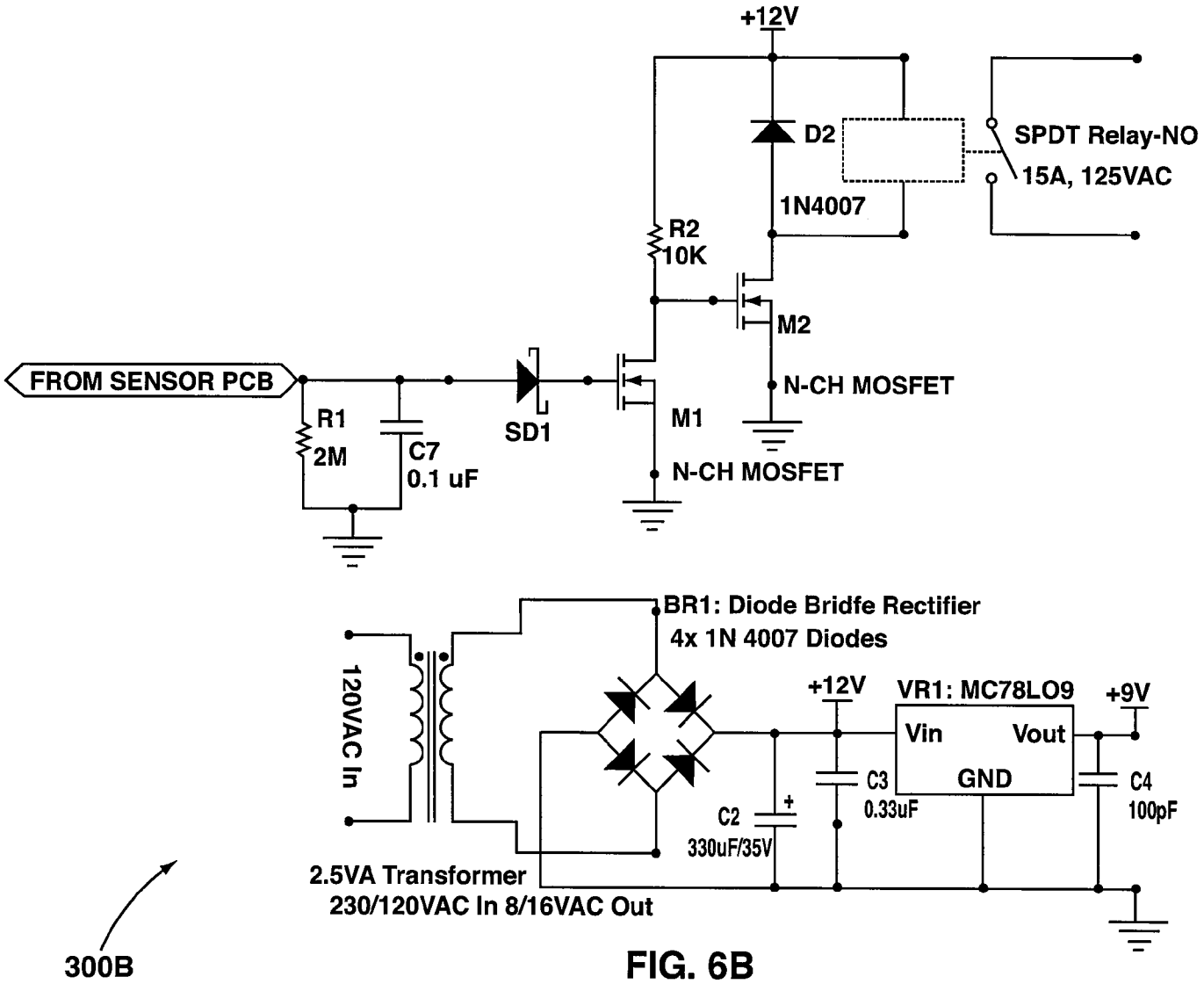
FIG. 6B shows another example circuit for the relay unit.

Referring to FIG. 6B, another example of an electrical circuit 300B for the relay unit 104 is provided. This power supply circuit uses a low-profile transformer that isolates between the live high voltage 120 VAC primary windings and the low voltage secondary windings. It uses also bridge rectifier diodes that convert the AC secondary voltage into rectified DC voltage, which is filtered by capacitors C2 and C3 before being applied to a 9 voltage regulator that maintains a constant 9 VDC power to the sensor unit 102 irrespective of the fluctuation in the line voltage.

Figure 7:
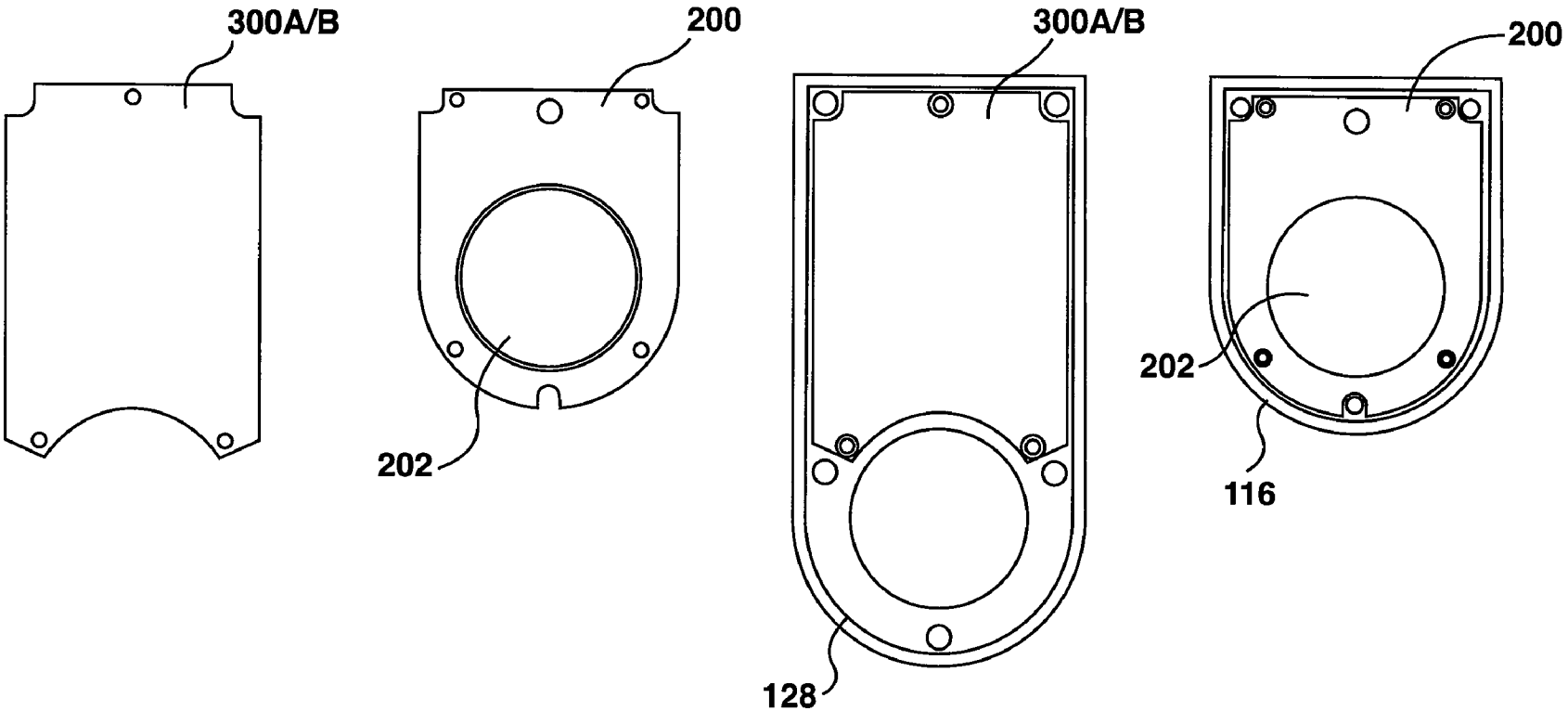
FIG. 7 shows the position of circuit boards in the sensor and relay units.

Referring to FIG. 7, the electrical circuits 200, 300A (or 300B) can be housed in the housing portions 116, 128 for the sensor and relay units 102, 104, respectively. The circuitry between the sensor and relay units 102, 104 operates as follows. The sensor circuit 202 output is oscillating. It is converted into a single up/down pulse using the Schmitt trigger, which is a resistor-capacitor-diode network (R10 and R11 on sensor unit 102 and R1, C1 and diode D1 on relay unit 104). This Schmitt trigger output drives two metal oxide semiconductor FET's (MOSFET's M1 and M2 in the relay unit 104) that energize/de-energize the coil circuit of the relay unit 102 normally in the ON state.

Figure 8:
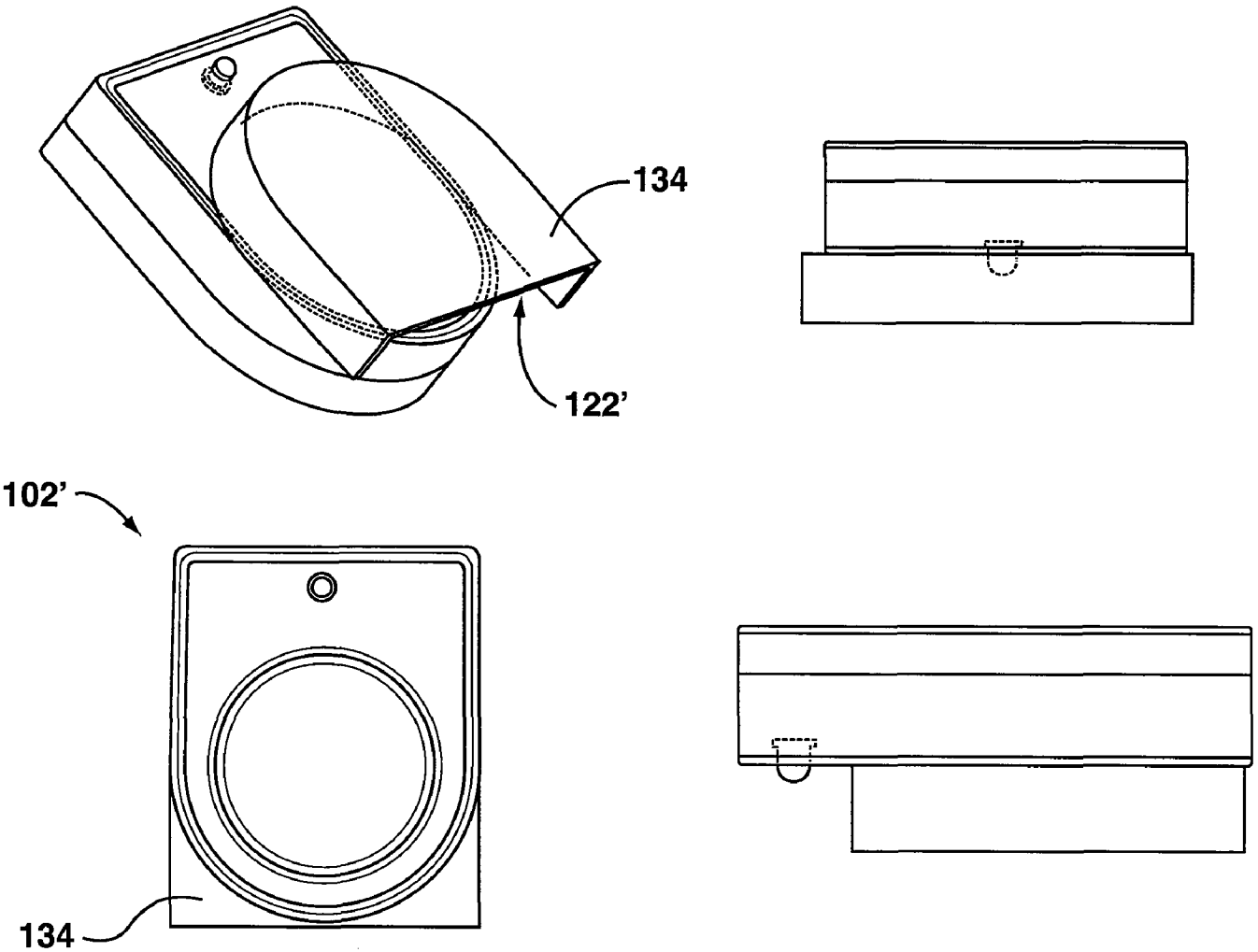
FIG. 8 shows views of another example of a sensor unit.

Referring to FIG. 8, another example of a sensor unit 102' is provided comprising a flanged portion 134 defining a smoke trap 122'. The smoke trap 122' provides a relatively wider trapping area for capturing exhaust air, as compared with smoke trap 122.

This specification is concerned with providing a means for shutting off power to an appliance if burning conditions are detected. The type and internal structure of the appliance may not necessarily affect the design of the safety sensor device. Furthermore, the safety sensor device in accordance with applicant's teachings may be applicable to various types of consumer appliances, for example but not limited to, microwave ovens, toasters, toaster ovens, countertop convection ovens, griddles, skillets, rice cookers, steamers, waffle irons, breadmakers, popcorn poppers, deep fryers, space heaters, floor heaters, humidifiers, dehumidifiers, washers, dryers, air conditioners, fridges, computers, fax machines, etc.

It will be appreciated by those skilled in the art that other variations of the one or more embodiments described herein are possible and may be practised without departing from the scope of the present invention as claimed herein.

I claim:

1. A safety sensor device comprising:

a) a sensor unit comprising a sensor configured to monitor exhaust air from an appliance; and b) a power control unit linked to the sensor unit, the unit comprising a circuit operable to electrically connect the appliance with a power source while in an ON state and electrically disconnect the appliance from the power source while in an OFF state, the circuit operable to transition from the ON state to the OFF state and from the OFF state to the ON state, the circuit being responsive to the sensor unit to transition from the ON state to the OFF state if the sensor detect at least one of burning conditions or at least one predetermined substance in air in excess of a predetermined concentration, wherein the circuit comprises a timing circuit for timing an interval during which the OFF state is maintained, the circuit transitioning to the ON state after duration of the interval.

2. The device of claim 1, wherein the sensor unit and the power control unit are linked by a cable, and the power control unit provides power to the sensor unit via the cable to power the sensor.

3. The device of claim 1, wherein the sensor unit and the power control unit are linked wirelessly.

4. The device of claim 1, wherein the sensor comprises at least one of an ionization sensor, a photoelectric sensor, or a laser sensor.

5. The device of claim 1, wherein the sensor comprises an ionization chamber, and the sensor unit comprises a sensor circuit linked to the sensor.

6. The device of claim 5, wherein the sensor circuit is Motorola™ MC14667-1.

7. The device of claim 6, wherein a resistor R5 of the circuit is set to a level corresponding to a desired sensitivity.

8. The device of claim 7, wherein the resistor R5 is set to approximately 820 KΩ.

9. The device of claim 1, wherein the power control unit is electrically isolated from the sensor unit.

10. The device of claim 9, wherein the power control unit comprises a transformer power supply.

11. The device of claim 10, wherein the power control unit comprises a switched mode power supply.

12. The device of claim 11, wherein the switched mode power supply comprises a torroidal transformer and an opto-coupler.

13. The device of claim 1, wherein the sensor unit comprises a buzzer for producing an audible alarm.

14. The device of claim 13, wherein the buzzer is a piezoelectric transducer.

15. The device of claim 14, wherein the unit comprises a test switch, and the test switch is configured to activate the piezoelectric transducer.

16. The device of claim 1, wherein the circuit of the power control unit is configured to electrically connect a power cord of the appliance with a power outlet of the power source.

17. In combination:

a) an appliance comprising:

an exhaust area; and a power cord; and b) a safety sensor device comprising:

a sensor unit positioned generally above the exhaust area of the appliance, the sensor unit comprising a sensor configured to monitor air emanating from the exhaust area of the appliance; and a relay unit linked to the sensor unit, the relay unit comprising a circuit operable to electrically connect the power cord of the appliance with a power outlet while in an ON state and electrically disconnect the power cord from the power outlet while in an OFF state, the circuit operable to transition from the ON state to the OFF state and from the OFF state to the ON state, the circuit being responsive to the sensor unit to transition from the ON state to the OFF state if the sensor detects burning conditions or at least one predetermined substance in air in excess of a predetermined concentration, wherein the circuit comprises a timing circuit for timing an interval during which the OFF state is maintained, the circuit transitioning to the ON state after duration of the interval.

18. The combination of claim 17, wherein the sensor comprises at least of an ionization sensor, a photoelectric sensor, or a laser sensor.

19. The combination of claim 17, wherein the relay unit is electrically isolated from the sensor unit.

20. The combination of claim 17, wherein the sensor unit comprises a smoke trap, and the smoke trap is positioned generally above the exhaust area of the appliance.

21. A method of monitoring use of an appliance, the method comprising:

a) positioning a sensor unit near an exhaust area of the appliance, the sensor unit configured to monitor exhaust air emanating from the appliance;

b) connecting a relay unit to a power supply path of the appliance, the relay unit linked to the sensor unit, the relay unit operable to electrically connect the appliance to a power source while in an ON state and electrically disconnect the appliance from the power source while in an OFF state, the relay unit operable to transition from the ON state to the OFF state and from the OFF state to the ON state;

c) detecting at sensor unit burning conditions or at least one predetermined substance in air in excess of a predetermined concentration;

d) if burning conditions are detected, automatically transitioning the relay unit from the ON state to the OFF state;

e) after transitioning to the OFF state, maintaining the OFF state for a time interval; and f) after the time interval, automatically transitioning the relay unit from the OFF state to the ON state.

* * * * *